US008199098B2

(12) United States Patent
Chen et al.

(10) Patent No.: US 8,199,098 B2
(45) **Date of Patent: *Jun. 12, 2012**

(54) DRIVING DEVICE AND DRIVING METHOD FOR LIQUID CRYSTAL DISPLAY

(75) Inventors: Chien-Hung Chen, Taipei County (TW); Chun-Chieh Chiu, Taoyuan County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 434 days.

This patent is subject to a terminal disclaimer.

(21) Appl. No.: 12/505,550

(22) Filed: Jul. 20, 2009

(65) Prior Publication Data

US 2010/0245340 A1 Sep. 30, 2010

(30) Foreign Application Priority Data

Mar. 27, 2009 (TW) ..... 98110234 A

(51) Int. Cl.
*G09G 3/36* (2006.01)

(52) U.S. Cl. ..... 345/99; 345/690

(58) Field of Classification Search ..... 345/87–89, 345/94, 99, 690, 204
See application file for complete search history.

(56) References Cited

U.S. PATENT DOCUMENTS

| | | | | |
|---|---|---|---|---|
| 6,310,600 | B1 * | 10/2001 | Koyama et al. | 345/103 |
| 6,861,810 | B2 * | 3/2005 | Rutherford | 315/169.3 |
| 6,943,763 | B2 * | 9/2005 | Shibata et al. | 345/89 |
| 7,034,788 | B2 * | 4/2006 | Someya et al. | 345/89 |
| 7,436,382 | B2 * | 10/2008 | Okuda et al. | 345/89 |
| 7,528,545 | B2 * | 5/2009 | Liao et al. | 313/506 |
| 7,876,300 | B2 * | 1/2011 | Baik et al. | 345/88 |
| 7,932,875 | B2 * | 4/2011 | Dallas et al. | 345/32 |
| 7,977,868 | B2 * | 7/2011 | Shieh et al. | 313/504 |
| 2002/0024481 | A1 * | 2/2002 | Kawabe et al. | 345/87 |
| 2002/0033813 | A1 * | 3/2002 | Matsumura et al. | 345/204 |
| 2002/0050965 | A1 * | 5/2002 | Oda et al. | 345/87 |
| 2006/0152531 | A1 * | 7/2006 | Lin et al. | 345/613 |
| 2008/0211755 | A1 | 9/2008 | Song et al. | |

FOREIGN PATENT DOCUMENTS

| | | |
|---|---|---|
| CN | 1909052 | 2/2007 |
| CN | 101345035 | 1/2009 |
| TW | I267044 | 11/2006 |

OTHER PUBLICATIONS

First Office Action of China Counterpart Application, issued on Sep. 15, 2011, p1-p6.

* cited by examiner

*Primary Examiner* — Ricardo L Osorio
(74) *Attorney, Agent, or Firm* — Jianq Chyun IP Office

(57) ABSTRACT

A driving device and a driving method for a liquid crystal display are provided. The driving device includes a memory unit, a comparator, a compensation unit, and a selector. The memory unit provides a previous image and a previous comparison result. The comparator compares a present image with the previous image and outputs a present comparison result. The compensation unit processes the present image according to the previous image to generate a plurality of processed present images. The selector selects and outputs one of the present image and the processed present images according to the previous comparison result and the present comparison result. Thereby, the space required in the memory unit is reduced and the image display quality is improved.

11 Claims, 5 Drawing Sheets

DRIVING DEVICE AND DRIVING METHOD FOR LIQUID CRYSTAL DISPLAY

CROSS-REFERENCE TO RELATED APPLICATION

This application claims the priority benefit of Taiwan application serial no. 98110234, filed Mar. 27, 2009. The entirety of the above-mentioned patent application is hereby incorporated by reference herein and made a part of specification.

BACKGROUND OF THE INVENTION

1. Field of the Invention

The present invention generally relates to a driving technique, and more particularly, to a driving technique for a liquid crystal display (LCD).

2. Description of Related Art

A liquid crystal display (LCD) has gradually replaced the conventional cathode ray tube (CRT) thanks to its small volume and low power consumption. Accordingly, LCD has been broadly applied to different devices, such as cell phones and digital billboards. However, when a dynamic image is displayed in a LCD, the slow reverse speed of the liquid crystal unit in the LCD may cause residual image and blur to be produced within the displayed image. As a result, the display quality of the dynamic image is not satisfactory.

Presently, regarding each dynamic image, the control circuit of a LCD performs an overdrive action to each liquid crystal unit in a changing state to increase the reverse speed of the liquid crystal unit. Thereby, the display quality of the dynamic image is improved and no residual image is produced.

Generally speaking, the overdrive technique is to adjust a present image according to one or more previous images. The more previous images are used, the more precisely the present image can be adjusted. However, the more previous images are adopted, the more memory units have to be used for storing these previous images. As a result, both the surface area and the fabrication cost of the chip are increased.

SUMMARY OF THE INVENTION

Accordingly, the present invention is directed to a driving device which may reduce the space required in a memory unit and improve the image display quality.

The present invention is also directed to a driving method for a liquid crystal display (LCD) which may improve the image display quality of the LCD.

The present invention provides a driving device including a memory unit, a comparator, a compensation unit, and a selector. The memory unit provides a previous image and a previous comparison result. The comparator is coupled to the memory unit, and the comparator compares a present image with the previous image and outputs a present comparison result. The compensation unit is coupled to the memory unit, and the compensation unit processes the present image according to the previous image to generate a plurality of processed present images. The selector is coupled to the compensation unit, the comparator, and the memory unit, and the selector selects and outputs one of the present image and the processed present images according to the previous comparison result and the present comparison result.

According to an embodiment of the present invention, the driving device further includes a writing controller coupled to the comparator and the memory unit. The writing controller writes the present comparison result into the memory unit to replace the previous comparison result and determines whether to write the present image into the memory unit to replace the previous image according to the present comparison result. If the present comparison result indicates that the present image is different from the previous image, the writing controller writes the present image into the memory unit to replace the previous image.

According to an embodiment of the present invention, the compensation unit includes a pre-tilt unit and an overdrive unit. The pre-tilt unit is coupled to the memory unit and the selector, and the pre-tilt unit pre-tilts the present image to generate a first processed present image among the processed present images. The overdrive unit is coupled to the memory unit and the selector, and the overdrive unit overdrives the present image to generate a second processed present image among the processed present images. If the present comparison result indicates that the present image is the same as the previous image, the selector outputs the present image. If the present comparison result indicates that the present image is different from the previous image and the previous comparison result indicates that the previous image is the same as the yet previous image, the selector outputs the first processed present image. If the present comparison result indicates that the present image is different from the previous image and the previous comparison result indicates that the previous image is different from the yet previous image, the selector outputs the second processed present image.

According to an embodiment of the present invention, the previous comparison result is 1 bit, and the present comparison result is 1 bit. The previous image is 7 bits, and the present image is 7 bits.

The present invention also provides a driving method for a LCD. The driving method includes following steps. A previous image and a previous comparison result stored in a memory unit are provided. Further, a present image is compared with the previous image and a present comparison result is output. In addition, the present image is processed according to the previous image to generate a plurality of processed present images. Besides, one of the present image and the processed present images is selected and output according to the previous comparison result and the present comparison result.

As described above, in the present invention, a present image is processed according to a previous image to generate a plurality of processed present images. Besides, the present image is compared with the previous image to generate a present comparison result. In addition, one of the present image and the processed present images is selected and output according to the previous comparison result and the present comparison result. Thereby, the image display quality can be improved.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
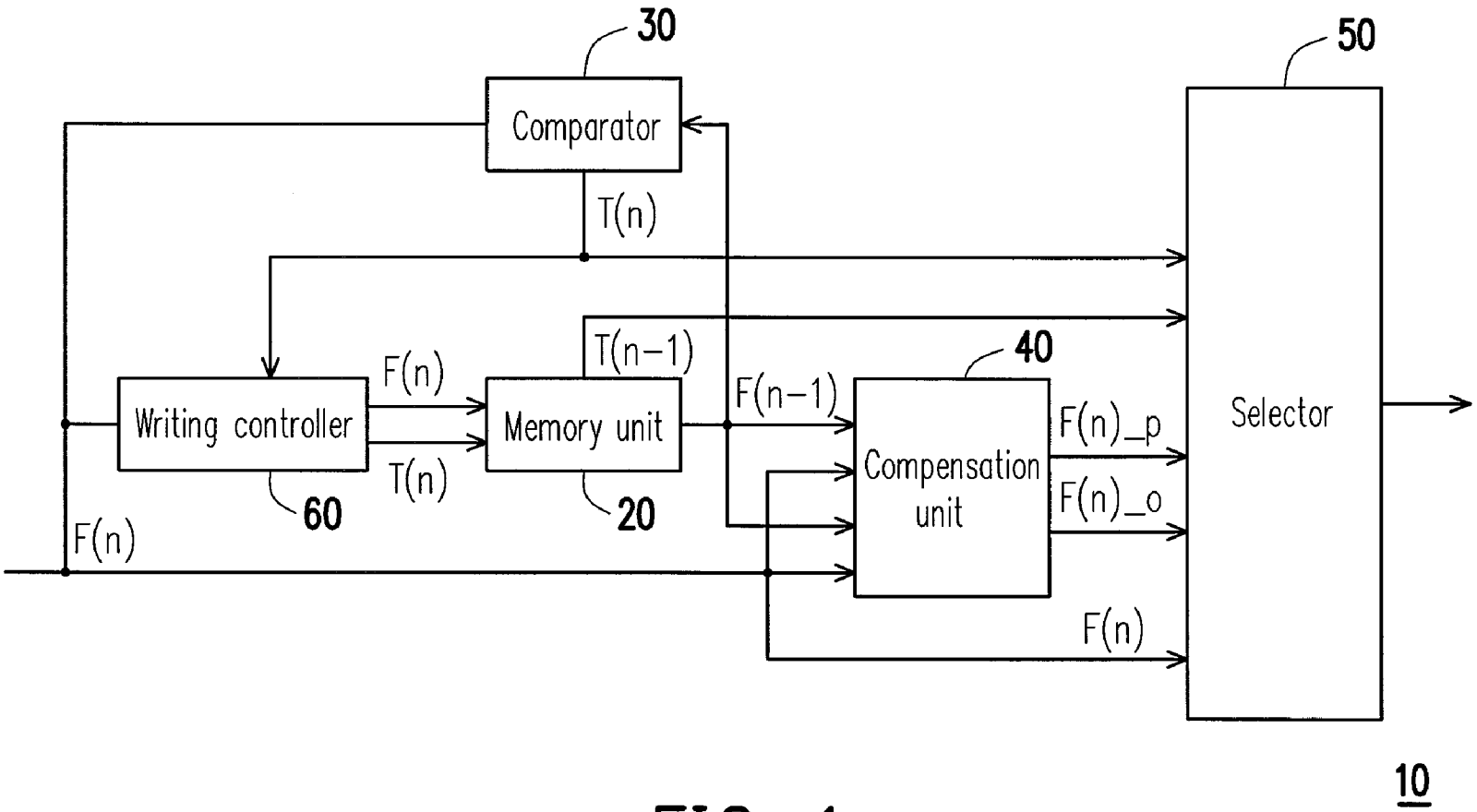
FIG. 1 is a block diagram of a driving device for a liquid crystal display (LCD) according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

In the conventional overdrive technique, the more previous images are used, the more precisely a present image can be adjusted. However, as a result, more memory units have to be adopted, which not only increases the surface area of the chip but the fabrication cost thereof.

Accordingly, in embodiments of the present invention, a plurality of continuous images is continuously compared to generate a plurality of comparison results. Each of the comparison results only indicates whether two continuous images are substantially the same therefore contains only a small quantity of data. Namely, only a small-quantity memory unit is used for storing these comparison results. On the other hand, different image processing could be performed to the present image to generate a plurality of processed present images. Then, one of the present image and the processed present images is selected and output according to the comparison results. Because the comparison results contain information of previous continuous images, the quality of a displayed image is effectively improved, and the space required in the memory unit is reduced. Below, exemplary embodiments of the present invention will be described with reference to accompanying drawings.

FIG. 1 is a block diagram of a driving device for a liquid crystal display (LCD) according to an embodiment of the present invention. Referring to FIG. 1, the driving device 10 is suitable for a LCD. The driving device 10 includes a memory unit 20, a comparator 30, a compensation unit 40, and a selector 50. Besides, the driving device 10 further includes a writing controller 60. The memory unit 20 is coupled to the comparator 30, the compensation unit 40, the selector 50, and the writing controller 60. The comparator 30 is coupled to the selector 50 and the writing controller 60. The compensation unit 40 is coupled to the selector 50.

The comparator 30, the compensation unit 40, the selector 50, and the writing controller 60 receive a present image F(n). In the present embodiment, it is assumed that the present image F(n) has a data quantity of 7 bits. The memory unit 20 may be a frame buffer which has two portions for respectively storing an image and a comparison result. Besides, the memory unit 20 provides a previous image F(n−1) to the comparator 30, the compensation unit 40, and the selector 50 and provides a previous comparison result T(n−1) to the selector 50, wherein the previous comparison result T(n−1) indicates whether the previous image F(n−1) is substantially the same as a yet previous image F(n−2).

As described above, the comparator 30 compares the present image F(n) with the previous image F(n−1) and generates a present comparison result T(n). For example, the comparator 30 respectively compares each pixel of the present image F(n) with each pixel of the previous image F(n−1). If all the pixels of the present image F(n) are the same as all the pixels of the previous image F(n−1), the present comparison result T(n) indicates that the present image F(n) is substantially the same as the previous image F(n−1). In the present embodiment, it is assumed that the present comparison result T(n) has a data quantity of 1 bit. If the present comparison result T(n) is 1, it indicates that the present image F(n) is substantially different from the previous image F(n−1); contrarily, if the present comparison result T(n) is 0, it indicates that the present image F(n) is substantially the same as the previous image F(n−1). In addition, the comparator 30 provides the present comparison result T(n) to the writing controller 60 and the selector 50.

The writing controller 60 writes the present comparison result T(n) into the memory unit 20 to replace the previous comparison result T(n−1) in the memory unit 20. Besides, the writing controller 60 writes the present image F(n) into the memory unit 20 to replace the previous image F(n−1) in the memory unit 20. In the present embodiment, the writing controller 60 determines whether to write the present image F(n) into the memory unit 20 according to the present comparison result T(n). If the present comparison result T(n) indicates that the present image F(n) is substantially the same as the previous image F(n−1), the writing controller 60 does not write the present image F(n) into the memory unit 20.

Figure 2:
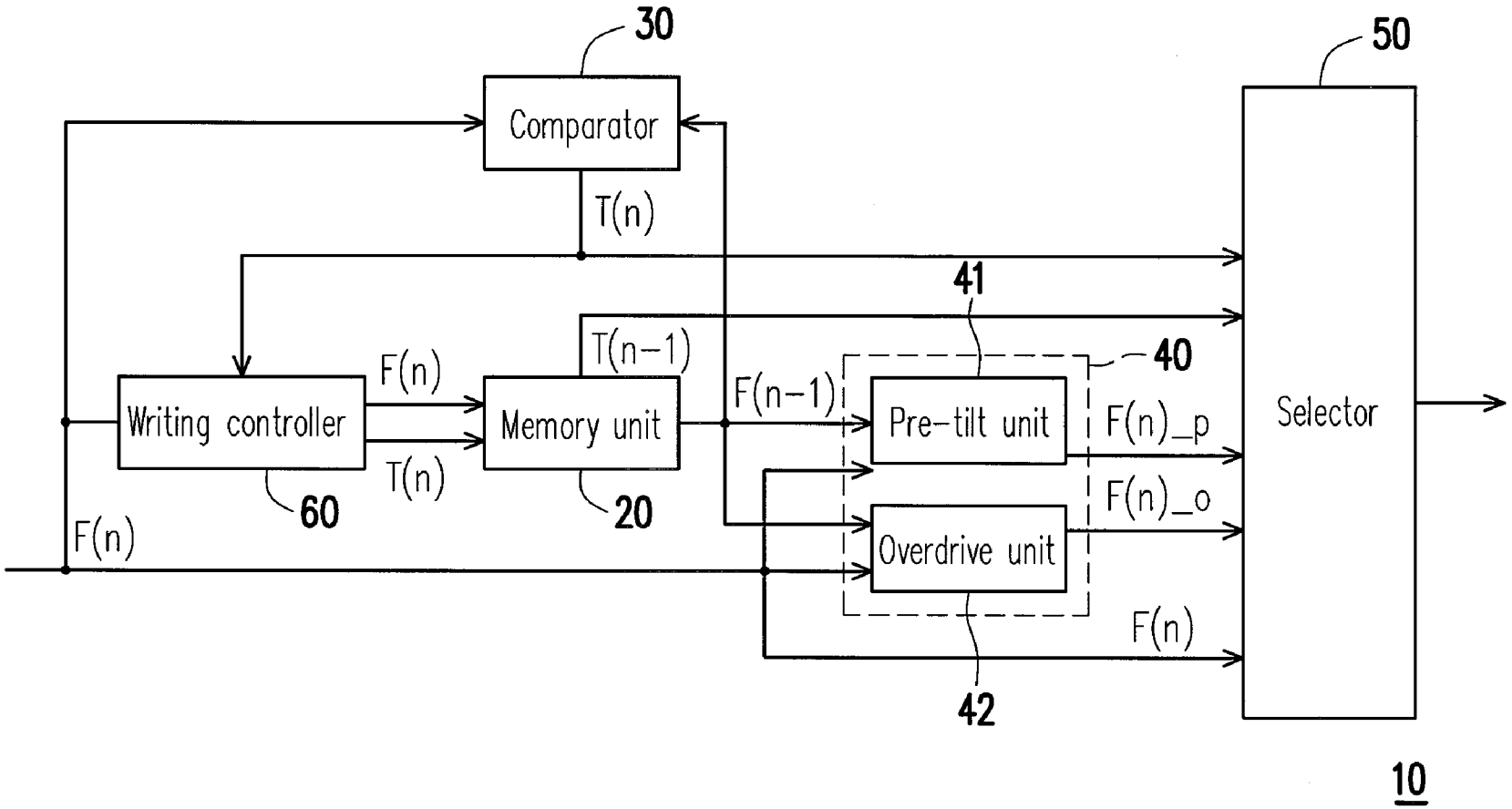
FIG. 2 is a detailed block diagram of a compensation unit in FIG. 1.

The compensation unit 40 processes the present image F(n) according to the previous image F(n−1) to generate a plurality of processed present images. FIG. 2 is a detailed block diagram of the compensation unit 40 in FIG. 1. Referring to FIG. 2, in the present embodiment, the compensation unit 40 includes a pre-tilt unit 41 and an overdrive unit 42. The pre-tilt unit 41 pre-tilts the present image F(n) according to the previous image F(n−1) to obtain a processed present image F(n)_p. To be specific, the pre-tilt unit 41 instantly generates the processed present image F(n)_p according to the previous image F(n−1) and the present image F(n) by using a look-up table.

Similarly, the overdrive unit 42 overdrives the present image F(n) according to the previous image F(n−1) to obtain a processed present image F(n)_o. To be specific, the overdrive unit 42 instantly generates the processed present image F(n)_o according to the previous image F(n−1) and the present image F(n) by using a look-up table.

Finally, the selector 50 selects and outputs one of the present image and the processed present images according to the previous comparison result T(n−1) and the present comparison result T(n). Below, an output pattern of the selector 50 will be provided in following table 1 to be referred by those skilled in the art.

TABLE 1

| An output pattern of the selector 50 | | |
|---|---|---|
| | T(n − 1) = 0 | T(n − 1) = 1 |
| T(n) = 0 | Output F(n) | Output F(n) |
| T(n) = 1 | Output F(n)_p | Output F(n)_o |

For example, if the present comparison result T(n) indicates that the previous image F(n−1) is substantially the same as the present image F(n), the selector 50 outputs the present image F(n). If the present comparison result T(n) indicates that the previous image F(n−1) is substantially different from the present image F(n) and the previous comparison result T(n−1) indicates that the previous image F(n−1) is substantially the same as the yet previous image F(n−2), the selector 50 output the processed present image F(n)_p. If the present comparison result T(n) indicates that the previous image F(n−1) is substantially different from the present image F(n) and the previous comparison result T(n−1) indicates that the previous image F(n−1) is substantially different from the yet previous image F(n−2), the selector 50 outputs the processed present image F(n)_o. Below, a driving method for LCD provided by the present invention will be described in detail with reference to accompanying drawings.

Figure 3:
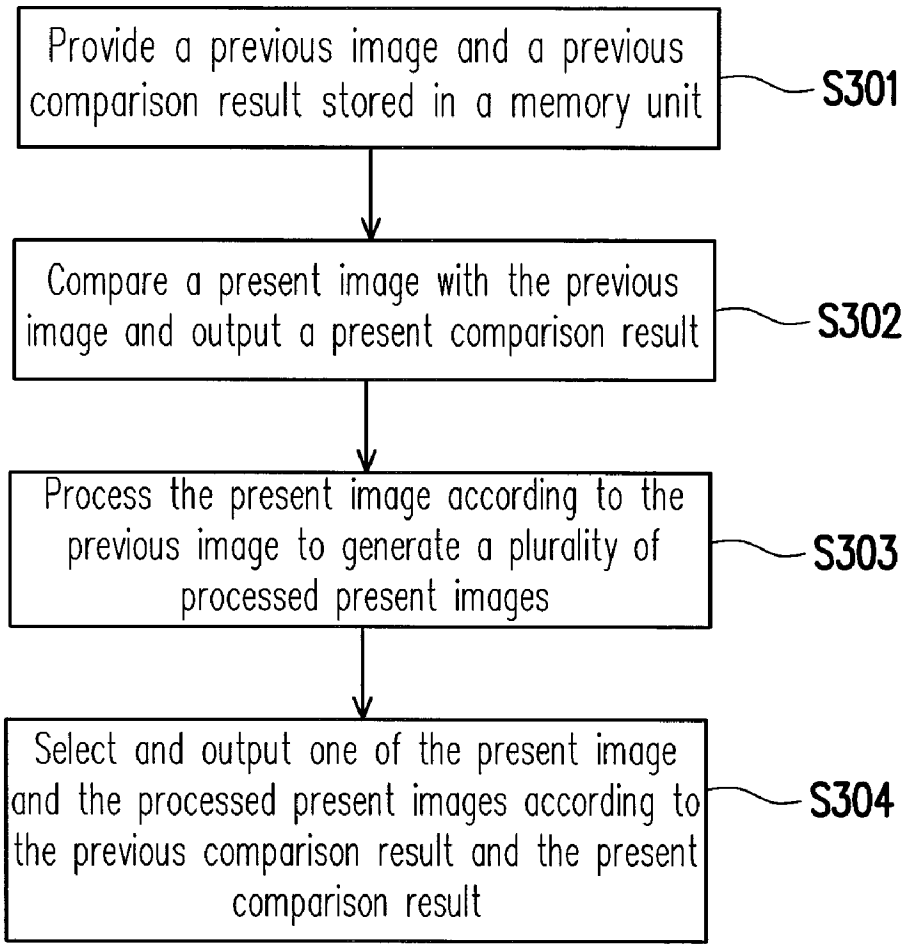
FIG. 3 is a flowchart of a driving method according to an embodiment of the present invention.
Figure 4:
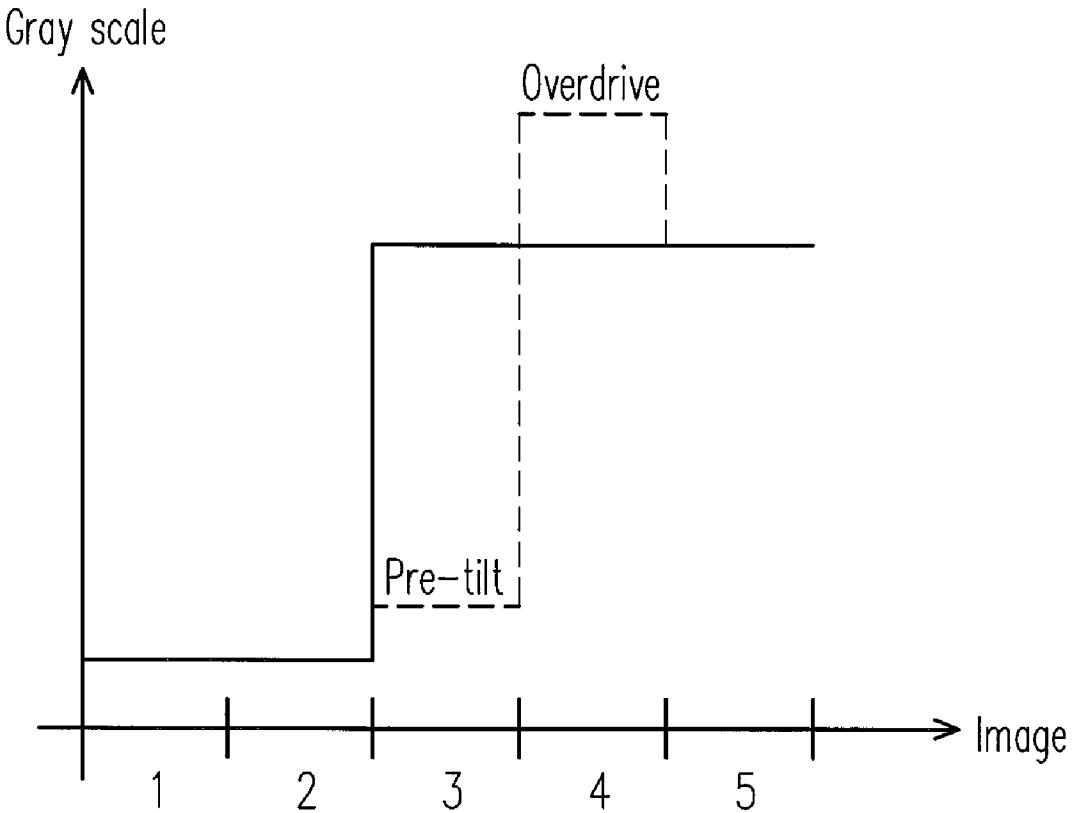
FIG. 4 is a grayscale view of continuous images according to an embodiment of the present invention.

FIG. 3 is a flowchart of a driving method according to an embodiment of the present invention. FIG. 4 is a grayscale view of continuous images according to an embodiment of the present invention. Referring to FIG. 1, FIG. 3, and FIG. 4, in the present embodiment, it is assumed that the grayscales of a first image and a second image are the same and the grayscales of a third image, a fourth image, and a fifth image are the same.

Switching from the First Image to the Second Image:

First, the second image is input into the comparator 30, the writing controller 60, the pre-tilt unit 41, and the overdrive unit 42. Then, in step S301, the memory unit 20 provides the previously stored first image to the comparator 30, the pre-tilt unit 41, and the overdrive unit 42. Next, in step S302, the comparator 30 compares the second image with the first image, and since the first image and the second image are substantially the same, the comparison result T(2) is 0. The comparator 30 outputs the comparison result T(2) (=0) to the writing controller 60 and the selector 50. After that, the writing controller 60 writes the comparison result T(2) (=0) into the memory unit 20. Because the comparison result T(2) is 0 (i.e., the first image and the second image are substantially the same), the writing controller 60 does not write the second image into the memory unit 20.

On the other hand, in step S303, the pre-tilt unit 41 generates a pre-tilted second image according to the first image and the second image and provides the pre-tilted second image to the selector 50. The overdrive unit 42 generates an overdriven second image according to the first image and the second image and provides the overdriven second image to the selector 50. Next, in step S304, since the comparison result T(2) is 0, the selector 50 outputs the unprocessed second image.

Switching from the Second Image to the Third Image:

First, the third image is input into the comparator 30, the writing controller 60, the pre-tilt unit 41, and the overdrive unit 42. Then, in step S301, the memory unit 20 provides the previously stored second image to the comparator 30, the pre-tilt unit 41, and the overdrive unit 42. In addition, the memory unit 20 provides the comparison result T(2) (=0) to the selector 50. Next, in step S302, the comparator 30 compares the third image with the second image, and since the third image and the second image are substantially different, the comparison result T(3) is 1. The comparator 30 outputs the comparison result T(3) (=1) to the writing controller 60 and the selector 50. After that, the writing controller 60 writes the comparison result T(3) (=1) into the memory unit 20 to replace the comparison result T(2) (=0). Since comparison result T(3) is 1 (i.e., the third image and the second image are substantially different), the writing controller 60 writes the third image into the memory unit 20 to replace the second image.

On the other hand, in step S303, the pre-tilt unit 41 generates a pre-tilt third image according to the second image and the third image and provides the pre-tilt third image to the selector 50. The overdrive unit 42 generates an overdriven third image according to the second image and the third image and provides the overdriven third image to the selector 50. Next, in step S304, since the comparison result T(2) is 0 and the comparison result T(3) is 1, the selector 50 outputs the pre-tilt third image.

Switching from the Third Image to the Fourth Image:

First, the fourth image is input into the comparator 30, the writing controller 60, the pre-tilt unit 41, and the overdrive unit 42. Then, in step S301, the memory unit 20 provides the previously stored third image to the comparator 30, the pre-tilt unit 41, and the overdrive unit 42. In addition, the memory unit 20 provides the comparison result T(3) (=1) to the selector 50. Next, in step S302, the comparator 30 compares the fourth image with the third image, and since the fourth image and the third image are substantially the same, the comparison result T(4) is 0. The comparator 30 outputs the comparison result T(4) (=0) to the writing controller 60 and the selector 50. After that, the writing controller 60 writes the comparison result T(4) (=0) into the memory unit 20 to replace the comparison result T(3) (=1). Since the comparison result T(4) is 0 (i.e., the fourth image and the third image are substantially the same), the writing controller 60 does not write the fourth image into the memory unit 20.

On the other hand, in step S303, the pre-tilt unit 41 generates a pre-tilt fourth image according to the third image and the fourth image and provides the pre-tilt fourth image to the selector 50. The overdrive unit 42 generates an overdriven fourth image according to the third image and the fourth image and provides the overdriven fourth image to the selector 50. Next, in step S304, since the comparison result T(3) is 1 and the comparison result T(4) is 0, the selector 50 outputs the overdriven fourth image.

Switching from the Fourth Image to the Fifth Image:

First, the fifth image is input into the comparator 30, the writing controller 60, the pre-tilt unit 41, and the overdrive unit 42. Then, in step S301, the memory unit 20 provides the previously stored fourth image to the comparator 30, the pre-tilt unit 41, and the overdrive unit 42. In addition, the memory unit 20 provides the comparison result T(4) (=0) to the selector 50. Next, in step S302, the comparator 30 compares the fifth image with the fourth image, and since the fifth image and the fourth image are substantially the same, the comparison result T(5) is 0. The comparator 30 outputs the comparison result T(5) (=0) to the writing controller 60 and the selector 50. After that, the writing controller 60 writes the comparison result T(5) (=0) into the memory unit 20 to replace the comparison result T(4) (=0). Since the comparison result T(5) is 0 (i.e., the fifth image and the fourth image are substantially the same), the writing controller 60 does not write the fifth image into the memory unit 20.

On the other hand, in step S303, the pre-tilt unit 41 generates a pre-tilt fifth image according to the fourth image and the fifth image and provides the pre-tilt fifth image to the selector 50. The overdrive unit 42 generates an overdriven fifth image according to the fourth image and the fifth image and provides the overdriven fifth image to the selector 50. Next, in step S304, since the comparison result T(4) is 0 and the comparison result T(5) is 0, the selector 50 outputs the unprocessed fifth image.

As described above, in the present embodiment, continuous images are compared and comparison results are generated. Since each of these comparison results has a data quantity of only 1 bit but at the same time can keep the information of two continuous images, not only the space required in the memory unit 20 is effectively reduced, but the response time of the liquid crystal unit is effectively shortened due to that the selector 50 can select and output the most suitable image (for example, a pre-tilt image or an overdriven image). Moreover, in the present embodiment, the selector 50 determines which image to output according to the two comparison results. The two comparison results contain information of three images, but the memory unit 20 only stores one image and one comparison result. Thus, in the present embodiment, the space required in the memory unit 20 won't be increased while the image display quality is improved.

It should be mentioned that even though a possible pattern of the driving device and the driving method for LCD in the present invention have been described in foregoing embodiment, it should be understood by those having ordinary knowledge in the art that every manufacturer has different design about the driving device and the LCD driving method. Thus, the application of the present invention is not limited to foregoing possible pattern. In other words, it is within the scope and spirit of the present invention as long as a present image is compared with a previous image to generate a present comparison result and one of the present image and a plurality of processed present images is selected and output according to a previous comparison result and the present comparison result. Below, some other embodiments of the present invention will be further described in order to allow those having ordinary knowledge in the art to fully understand the spirit of the present invention.

Figure 5:
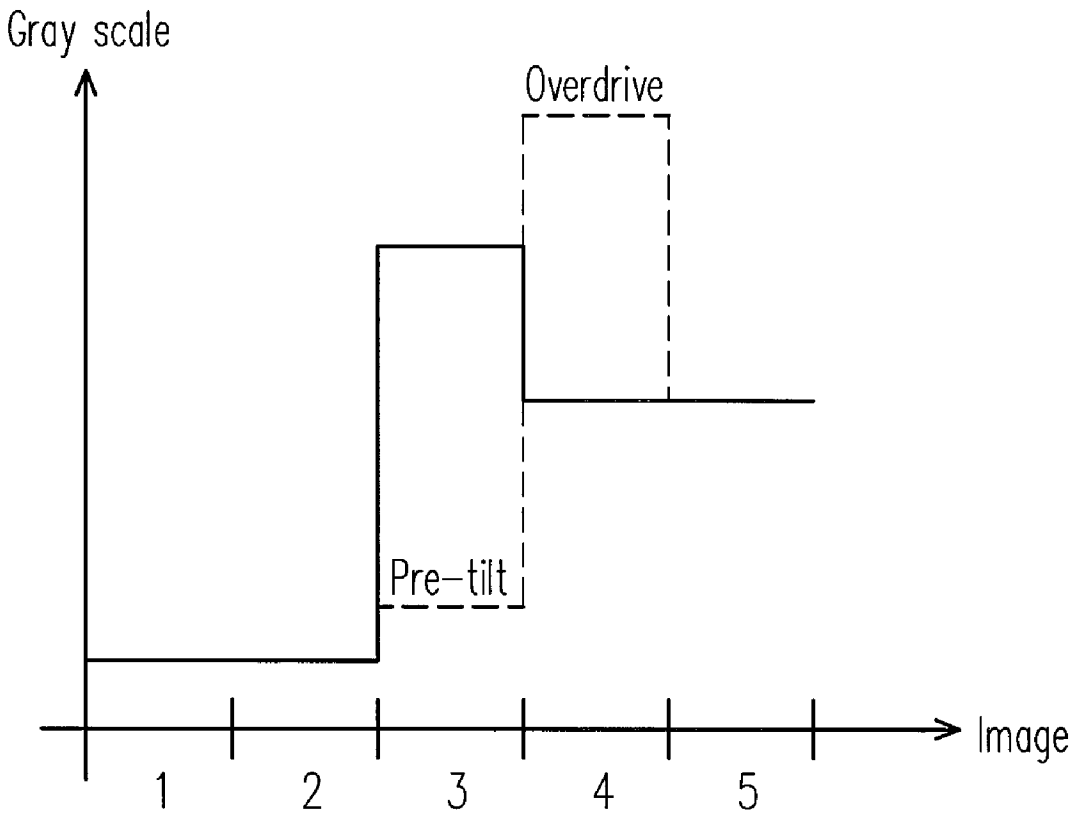
FIG. 5 is a grayscale view of continuous images according to another embodiment of the present invention.

The present invention is not limited to the embodiment described above. FIG. 5 is a grayscale view of continuous images according to another embodiment of the present invention. Referring to FIG. 1, FIG. 3, and FIG. 5, in the present embodiment, it is assumed that the grayscales of the first image and the second image are the same and the grayscales of the fourth image and the fifth image are the same.

Referring to FIG. 3, when it is switched from the first image to the second image, the comparison result T(2) is 0, and accordingly the selector 50 outputs the unprocessed second image. When it is switched from the second image to the third image, the comparison result T(3) is 1, and accordingly the selector 50 outputs the pre-tilt third image. When it is switched from the third image to the fourth image, the comparison result T(4) is 1, and accordingly the selector 50 outputs the overdriven fourth image. When it is switched from the fourth image to the fifth image, the comparison result T(5) is 0, and accordingly the selector 50 outputs the unprocessed the fifth image.

Referring to FIG. 2 again, in the embodiment described above, the compensation unit 40 includes the pre-tilt unit 41 and the overdrive unit 42. However, the present invention is not limited thereto, and the compensation unit 40 can be differently implemented by those skilled in the art according to the actual requirement. For example, in another embodiment of the present invention, the pre-tilt unit 41 is replaced by another overdrive unit. Namely, the compensation unit 40 includes a plurality of overdrive units which respectively execute different overdrive processes, and the selector 50 selects and outputs a suitable image according to a plurality of comparison results, so as to accomplish a similar function as that described in foregoing embodiment.

Moreover, in yet another embodiment of the present invention, the overdrive unit 42 is replaced by another pre-tilt unit. Namely, the compensation unit 40 includes a plurality of pre-tilt units which respectively execute different pre-tilt processes, and the selector 50 selects and outputs a suitable image according to a plurality of comparison results, so as to accomplish a similar function as that described in foregoing embodiment.

Referring to FIG. 2, in the embodiment described above, the comparator 30 respectively compares each pixel of the present image F(n) with each pixel of the previous image F(n−1), so as to determine whether the present image F(n) is substantially the same as the previous image F(n−1). However, the present invention is not limited thereto. In another embodiment of the present invention, the comparator 30 performs corresponding sampling comparison to the present image F(n) and the previous image F(n−1). If all the correspondingly sampled pixels are the same, the comparator 30 determines that the present image F(n) is substantially the same as the previous image F(n−1), and if one or more correspondingly sampled pixels are different, the comparator 30 determines that the present image F(n) is substantially different from the previous image F(n−1).

Referring to FIG. 2 again, in the embodiment described above, the memory unit 20 only stores one comparison result and provides a previous comparison result T(n−1) to the selector 50. However, the present invention is not limited. The memory unit 20 may also be differently implemented by those skilled in the art according to the actual requirement. For example, in another embodiment of the present invention, the memory unit 20 stores multiple comparison results and provides multiple previous comparison results (for example, the previous comparison results T(n−1) and T(n−2) to the selector 50). It should be mentioned that the compensation unit 40 may also be disposed with up to 7 image processing devices according to the implementation of the memory unit 20 and outputs the processed images to the selector 50. Accordingly, the selector 50 can select and output a suitable image from 8 different possibilities according to the present comparison result T(n) and the previous comparison results T(n−1) and T(n−2).

Similarly, in the embodiment described above, the memory unit 20 stores only one previous image T(n−1). However, the present invention is not limited thereto. In other embodiments of the present invention, the memory unit 20 may also store multiple previous images, such as previous images T(n−1) and T(n−2). Accordingly, the image display quality can be further improved.

Referring to FIG. 2 again, in the embodiment described above, the present image F(n) and the previous image F(n−1) respectively have a data quantity of 7 bits. However, the present invention is not limited thereto, and the data quantity of the present image F(n) and the previous image F(n−1) can be determined by those skilled in the art according to the actual requirement. For example, in other embodiments of the present invention, the data quantity of the present image F(n) and the previous image F(n−1) may also be other numbers of bits, such as 15 bits. Similarly, the data quantity of the present comparison result T(n) and the previous comparison result T(n−1) is not limited to 1 bit.

As described above, in the present invention, a present image is compared with a previous image and accordingly a present comparison result is generated. In addition, one of the present image and a plurality of processed present images is selected and output according to a previous comparison result and the present comparison result. Thereby, the image display quality is improved. Moreover, the embodiments of the present invention further has following advantages:

1. A comparison result containing information of two images takes up a space of only 1 bit in a memory unit so that the space taken in the memory unit can be effectively reduced.

2. A memory unit can store multiple previous images and multiple previous comparison results so that the image display quality can be further improved.

3. A compensation unit can execute many different image processing and provide a plurality of processed images to be selected and output by a selector. Accordingly, the image display quality can be further improved.

4. Various image processing units in a compensation unit can process image simultaneously so that the problem of image delay caused long image processing time can be avoided.

5. An overdrive unit and a pre-tilt unit can effectively shorten the response time of a liquid crystal unit so that the motion blur problem in LCD can be resolved.

6. A compensation unit can speed up image processing by adopting a look-up table.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A driving device, comprising:

a memory unit, for providing a previous image and a previous comparison result;

a comparator, coupled to the memory unit, for comparing a present image with the previous image and outputs a present comparison result;

a compensation unit, coupled to the memory unit, for processing the present image according to the previous image to generate a plurality of processed present images; and a selector, coupled to the compensation unit, the comparator, and the memory unit, for selecting and outputting one of the present image and the processed present images according to the previous comparison result and the present comparison result, wherein the compensation unit further comprising:

a pre-tilt unit, coupled to the memory unit and the selector, for pre-tilting the present image to generate a first processed present image among the processed present images; and an overdrive unit, coupled to the memory unit and the selector, for overdriving the present image to generate a second processed present image among the processed present images.

2. The driving device according to claim 1 further comprising:

a writing controller, coupled to the comparator and the memory unit, for writing the present comparison result into the memory unit to replace the previous comparison result, and determining whether to write the present image into the memory unit to replace the previous image according to the present comparison result.

3. The driving device according to claim 2, wherein if the present comparison result indicates that the present image is different from the previous image, the writing controller writes the present image into the memory unit to replace the previous image.

4. The driving device according to claim 1, wherein if the present comparison result indicates that the present image is the same as the previous image, the selector outputs the present image; if the present comparison result indicates that the present image is different from the previous image and the previous comparison result indicates that the previous image is the same as a yet previous image, the selector outputs the first processed present image; and if the present comparison result indicates that the present image is different from the previous image and the previous comparison result indicates that the previous image is different from the yet previous image, the selector outputs the second processed present image.

5. The driving device according to claim 1, wherein the previous comparison result is 1 bit, and the present comparison result is 1 bit.

6. The driving device according to claim 1, wherein the previous image is 7 bits, and the present image is 7 bits.

7. A driving method for a liquid crystal display (LCD), comprising:

providing a previous image and a previous comparison result stored in a memory unit;

comparing a present image with the previous image and outputting a present comparison result;

processing the present image according to the previous image to generate a plurality of processed present images; and selecting and outputting one of the present image and the processed present images according to the previous comparison result and the present comparison result, wherein the step of processing the present image according to the previous image to generate a plurality of processed present images comprising:

pre-tilting the present image to generate a first processed present image among the processed present images; and overdriving the present image to generate a second processed present image among the processed present images.

8. The driving method according to claim 7 further comprising:

writing the present comparison result into the memory unit to replace the previous comparison result; and if the present comparison result indicates that the present image is different from the previous image, writing the present image into the memory unit to replace the previous image.

9. The driving method according to claim 7, wherein the step of selecting one of the present image and the processed present images according to the previous comparison result and the present comparison result comprises:

if the present comparison result indicates that the present image is the same as the previous image, outputting the present image;

if the present comparison result indicates that the present image is different from the previous image and the previous comparison result indicates that the previous image is the same as a yet previous image, outputting the first processed present image; and if the present comparison result indicates that the present image is different from the previous image and the previous comparison result indicates that the previous image is different from the yet previous image, outputting the second processed present image.

10. The driving method according to claim 7, wherein the previous comparison result is 1 bit, and the present comparison result is 1 bit.

11. The driving method according to claim 7, wherein the previous image is 7 bits, and the present image is 7 bits.

* * * * *